US012006823B2

(12) United States Patent
Cartechini

(10) Patent No.: US 12,006,823 B2
(45) Date of Patent: Jun. 11, 2024

(54) ROCK CRUSHING UNIT FOR WIDENING A PILOT HOLE MADE ON ROCKY TERRAIN

(71) Applicant: HPM HYDRAULIC PERFORMANCE MACHINES S.r.l., Recanati (IT)

(72) Inventor: Giuseppe Cartechini, Recanati (IT)

(73) Assignee: HPM HYDRAULIC PERFORMANCE MACHINES S.r.l. (IT)

( * ) Notice: Subject to any disclaimer, the term of this patent is extended or adjusted under 35 U.S.C. 154(b) by 269 days.

(21) Appl. No.: 17/437,223

(22) PCT Filed: Mar. 16, 2020

(86) PCT No.: PCT/IB2020/052369
§ 371 (c)(1),
(2) Date: Sep. 8, 2021

(87) PCT Pub. No.: WO2020/183441
PCT Pub. Date: Sep. 17, 2020

(65) Prior Publication Data

US 2022/0170326 A1 Jun. 2, 2022

(30) Foreign Application Priority Data

Mar. 14, 2019 (IT) ..... 102019000003721

(51) Int. Cl.
*E21B 7/28* (2006.01)
*E21B 10/34* (2006.01)

(52) U.S. Cl.
CPC ..... *E21B 7/28* (2013.01); *E21B 10/345* (2013.01)

(58) Field of Classification Search
CPC ... E21B 10/345; E21B 7/28; E21B 10/32–322
See application file for complete search history.

(56) References Cited

U.S. PATENT DOCUMENTS 3,358,782 A 12/1967 Gunter
3,425,500 A * 2/1969 Fuchs ..... E21B 10/345 175/269
4,274,675 A * 6/1981 Paurat ..... E21B 4/16 299/56

(Continued)

FOREIGN PATENT DOCUMENTS

DE 4028596 A1 3/1992
EP 2364393 A1 9/2011

*Primary Examiner* — Theodore N Yao
(74) *Attorney, Agent, or Firm* — Endurance Law Group PLC

(57) ABSTRACT

Using a rock crushing system for widening a pilot hole on rocky terrain includes taking a plurality of crushing elements, for example roller bits and/or cutter discs, pressing the crushing elements against the lateral wall of the pilot hole and at the same time rolling the crushing elements along a cylindrical portion of the lateral wall, widening the pilot hole. The crushing elements, free to rotate with respect to an axis thereof, are radially pushed by hydraulic cylinders. Stabilising means exemplarily include a basket abutting the lateral wall to keep a main body bearing the hydraulic cylinders centered with respect to an axis of the pilot hole during the rock crushing.

14 Claims, 8 Drawing Sheets

(56) References Cited

U.S. PATENT DOCUMENTS

| | | | | |
|---|---|---|---|---|
| 4,494,617 | A * | 1/1985 | Snyder | E21D 1/06 175/94 |
| 5,219,246 | A | 6/1993 | Coutts | |
| 5,590,724 | A * | 1/1997 | Verdgikovsky | E21B 10/345 175/57 |
| 5,992,542 | A | 11/1999 | Rives | |
| 8,770,323 | B2 | 7/2014 | Seegmiller | |
| 10,689,913 | B2 * | 6/2020 | Costa de Oliveira | E21B 44/04 |
| 2016/0305189 | A1 | 10/2016 | Lubberger | |
| 2018/0223600 | A1 * | 8/2018 | Loikkanen | E21B 7/28 |
| 2020/0240215 | A1 * | 7/2020 | Estes | E21B 7/28 |

* cited by examiner

ROCK CRUSHING UNIT FOR WIDENING A PILOT HOLE MADE ON ROCKY TERRAIN

TECHNICAL SECTOR OF THE INVENTION

The present invention relates to the technical sector concerning the realising of holes on rocky terrain, for example for foundation poles for buildings, bridges, for pylons or walls. More in particular, the invention relates to a rock crushing for widening a pilot hole previously made on rocky terrain.

DESCRIPTION OF THE PRIOR ART

At present, to make a hole of a limited diameter on rocky terrain, a tool known as a "down the hole hammer" can be used. A down the hole hammer is a device comprising: a plurality of crushing buttons; and a crushing head which is provided with a plurality of seats, for receiving the crushing buttons so that the buttons project to contact the rock to be crushed, and which is provided with a plurality of channels for passage of the crushed rock externally of the hole under formation. During use, the down the hole hammer is: subjected to a vibratory motion along the axis thereof by means of compressed air; drawn in rotation with respect to the axis thereof; and advanced along the hole under formation as the rock is progressively crushed and is conveyed to the outside by the compressed air. The compressed air has the function of providing the vibratory motion of the down the hole hammer and of pushing the crushed rock towards the outside.

Each down the hole hammer is suitable for realising a hole having a predetermined diameter. Should it be necessary to make a hole having a different diameter, then it would also be necessary to obtain another down the hole hammer suitable for the different diameter.

This constitutes a drawback, as each device of the above-described type has a significant size and cost.

For holes of large dimensions, for example a diameter of greater than 1 metre, it becomes very expensive to use a single down the hole hammer having a diameter corresponding to that of the hole to be obtained, as well as requiring a great deal of space.

As an alternative, see FIG. 1, a rock crushing unit (100) can be used that comprises: a basket (110) for receiving the crushed rock; a plurality of down the hole hammers (120) of the type described in the foregoing; and a main head (130) which bears the down the hole hammers (120), in such a way that they project, and which is provided with a plurality of channels (140) for aspirating the crushed rock and conveying it towards the basket (110). During the use of this rock crushing unit (100) each down the hole hammer (120) is subjected to a vibratory motion along the axis thereof, and the main head (130) is drawn in rotation with respect to the axis thereof. The rock crushing unit (100) is progressively advanced as the rock is crushed and aspirated and conveyed into the basket (110). The down the hole hammers (120) are distributed on the main head (130) so that the rotation of the main head (130) enables the down the hole hammers (120) to sweep the whole bottom of the hole (200) during the step of realising the hole. The rock crushing unit (100) is extracted periodically to empty the basket (110).

Whether using a single down the hole hammer or a main head provided with a plurality of down the hole hammers (in the case of a rock perforating unit), for activation thereof and expulsion of the crushed rock a high flow-rate of air is required. The air flow increases as the diameter of the hole to be made increases.

In cases where holes are to be made in places that are difficult to access, the transport of the single down the hole hammer or the rock crushing unit and compressors can become an issue.

Each rock perforating unit is suitable to realise a hole having a predetermined diameter. Should it be necessary to make a hole having a different diameter, then it would be necessary to obtain another rock perforating unit suitable for the different diameter.

To reduce the number of compressors necessary when one down the hole hammer is not sufficient to make the hole, a known practice is the following: a pilot hole is made with a single down the hole hammer, which is concentric to the hole to be made and has a smaller diameter than the hole to be made; thereafter, a rock crushing unit is used (also known as a hole opener, not illustrated) which differs from the one described in the foregoing due to the fact that the down the hole hammers it holds are only distributed along the periphery of the main head. This enables, given a same diameter of the hole to be made, the use of a smaller number of compressors. However, this is only a partial solution to the above-described drawbacks.

To summarise, in order to realise large-diameter holes, i.e. in a range going from 6' to 10' (1800-3000 mm), a single down the hole hammer could be used, or a rock perforating unit, having a plurality of down the hole hammers. Both the solutions would have the following drawbacks: the compressors would be in a high number, which would lead to problems of space in the worksite, transport and cost; the down the hole hammers would be expensive and might make only one hole of the predetermined diameter.

Alternatively, hole openers could be used, which can be activated by a smaller number of compressors, but which however have the following drawbacks: they are expensive; they are usable for a predetermined diameter; they are less productive with respect to a single down the hole hammer.

SUMMARY OF THE INVENTION

The aim of the present invention consists in finding a solution which enables obtaining holes of different diameter and which does not require the use of compressors.

The aim is attained with a rock crushing unit according to claim 1 or claim 2 and by means of a rock crushing method according to claim 15.

The pilot hole can be realised for example with only one down the hole hammer. Thereafter the unit or the rock crushing method of the invention can be used, which enables progressive widening of the pilot hole up to a desired diameter: this is advantageous due to the fact that it is possible to obtain holes of different diameters, while in the prior art it was necessary to have recourse to a plurality of different rock crushing units (one for each hole diameter that was to be obtained, see FIG. 1 once more).

A further advantage consists in the fact that the rock crushing unit or method of the invention does not require the use, in order to function, of down the hole hammers, and therefore does not require a plurality of compressors for the air.

The rock crushing unit of claim 1 comprises a first plurality of arms which are arranged in such a way that the reaction forces mutually compensate: for this reason the stabilising means are not included, as they are not considered essential. The stabilising means are however preferable if the rocky terrain is not homogeneous.

The rock crushing unit of claim 2 comprises at least one arm and stabilising means: in a case where one arm only is included, the stabilising means are therefore essential to maintain the main body centred with respect to the axis of the pilot hole during the use of the rock crushing unit.

The forces crushing the rock are advantageously comparable to those obtainable with down the hole hammers, but without the need to use compressed air.

BRIEF DESCRIPTION OF THE DRAWINGS

Specific embodiments of the invention will be described in the following part of the present description, according to what is set down in the claims and with the aid of the appended tables of drawings, in which:

DESCRIPTION OF PREFERRED EMBODIMENTS

Figure 1A:
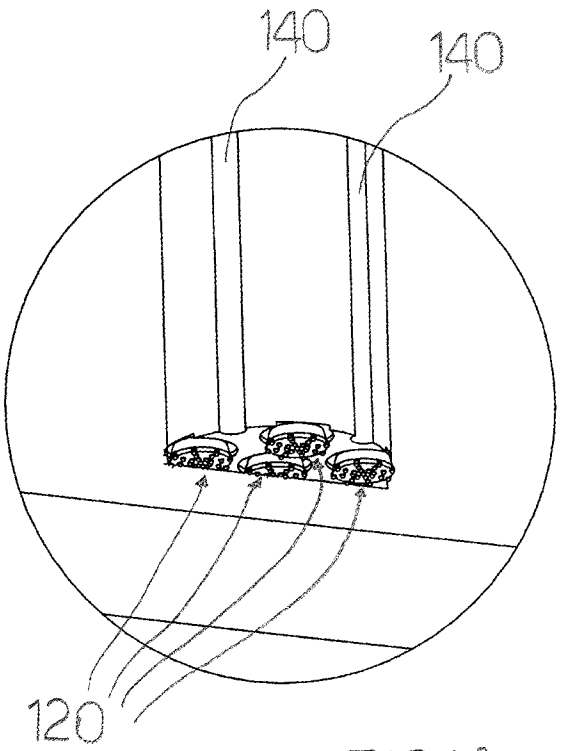
FIG. 1A is a larger-scale view of K1 in FIG. 1.
Figure 1:
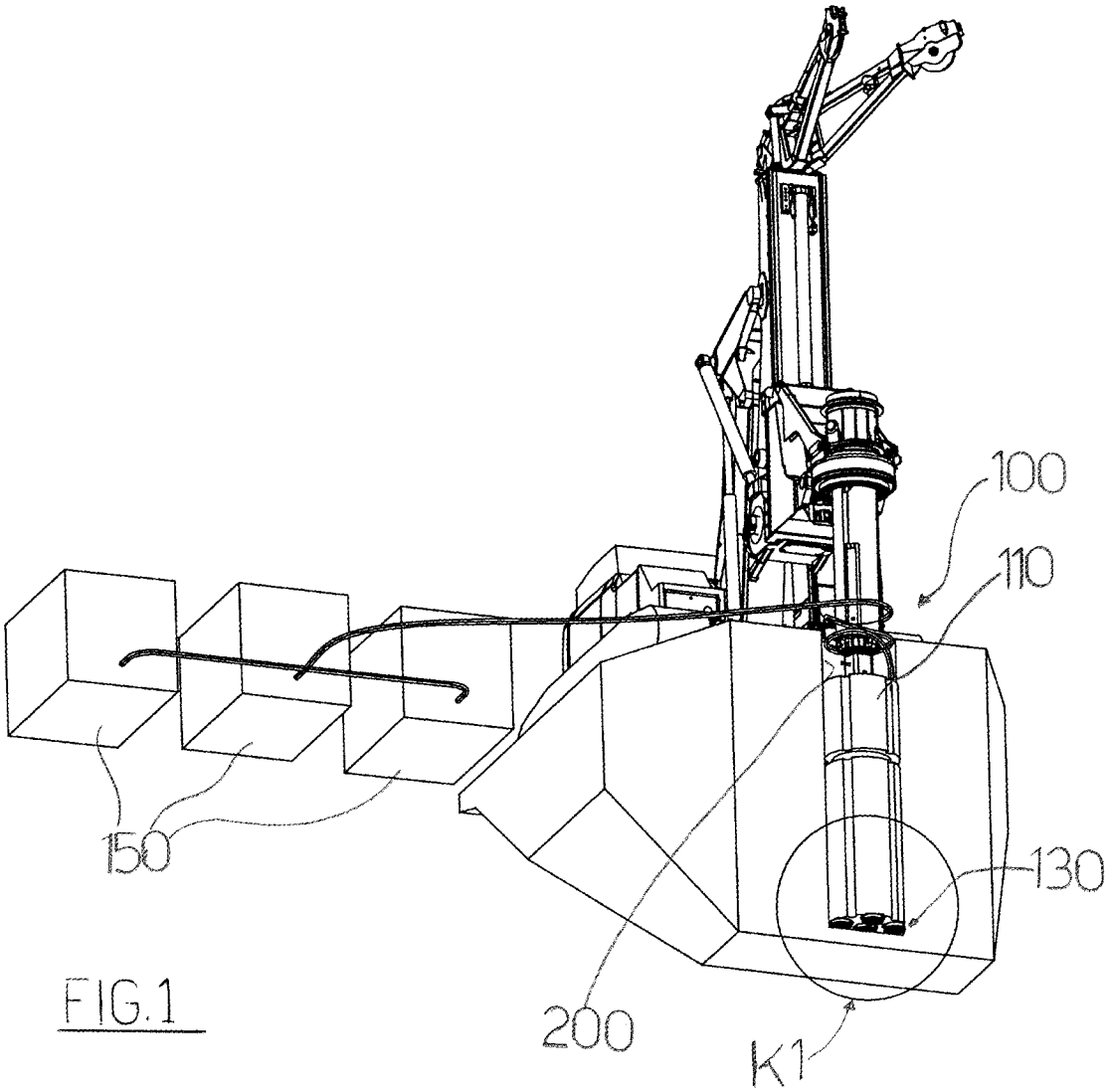
FIG. 1 is a perspective view of a rock crushing machine of known type, comprising a rock crushing unit and a plurality of compressors; and a portion of rocky terrain in section, in which the rock crushing machine is creating a hole.

In the following, reference will be made to figures from 2 onwards.

A rock crushing unit (1) for widening a pilot hole (3) realised on rocky terrain (4) is described according to a first invention and a second invention.

The rock crushing unit (1) according to the first invention comprises: a main body (2) (see FIGS. 4B, 10A-10F, 11A-11F) dimensioned so as to insert in a pilot hole (3) (FIGS. 2, 3) realised on rocky terrain (4) and activatable in rotation with respect to the axis thereof; first actuator means (5) which are borne by the main body (2) and which comprise a plurality of hydraulic cylinders (55, 63, 64); a first plurality of arms (51) which are borne by the main body (2) and which are activatable by the hydraulic cylinders of the plurality of hydraulic cylinders (55, 63, 64) in order each to move between a retracted position (R) (FIGS. 2, 2A, 8A, 8B, 10A, 10D, 11A, 11D) and an extended position (E) (FIGS. 4, 4A, 4B, 9A, 9B, 10C, 10F, 11C, 11F) with a planar movement that is perpendicular to the axis of the main body (2) (compare FIGS. 2A, 3A, 4A, FIGS. 10A-10F and FIGS. 11A-11F); a first plurality of crushing elements (21) for crushing rock, each of which is borne by an arm of the first plurality of arms (51), is rotatable with respect to the cited arm of the first plurality of arms (51) and is arranged in order to be able to press against, and roll along, the lateral wall of the pilot hole (3) during use of the rock crushing unit (1), i.e. when the main body (2) is inserted in the pilot hole (3) and is drawn in rotation with respect to the axis thereof and when the hydraulic cylinders of the plurality of hydraulic cylinders (55, 63, 64) activate the first plurality of arms (51) so that they move towards the extended position (E); the rock crushing unit (1) being configured so that when in use, the action exerted by the crushing elements of the first plurality of crushing elements (21) on the lateral wall of the pilot hole (3) determines the crushing of the lateral wall of the pilot hole (3) and thus the widening of the pilot hole (3) (compare FIGS. 3 and 4, and FIGS. 6 and 7); the arms of the first plurality of arms (51) being arranged in such a way that when the crushing unit is in use, the reaction forces which are generated on the arms of the first plurality of arms (51), and which are due to the pressure exerted by the crushing elements of the first plurality of crushing elements (21) on the lateral wall of the pilot hole (3), compensate one another (for example, in the embodiment of FIGS. 2-9 the arms are angularly equidistanced with respect to one another).

In other words, when the arms of the first plurality of arms (51) are in the extended position (E), then they project more greatly from the main body (2) with respect to when they are in the retracted position (R).

Figure 2A:
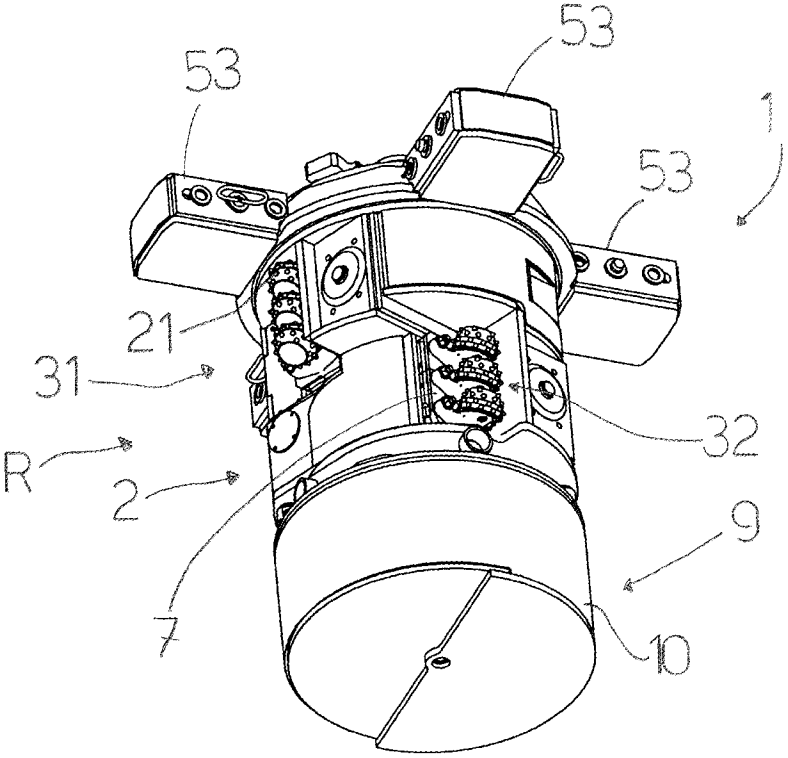
FIG. 2A is a perspective view of the rock crushing unit of FIG. 2 in a first operating configuration.
Figure 2:
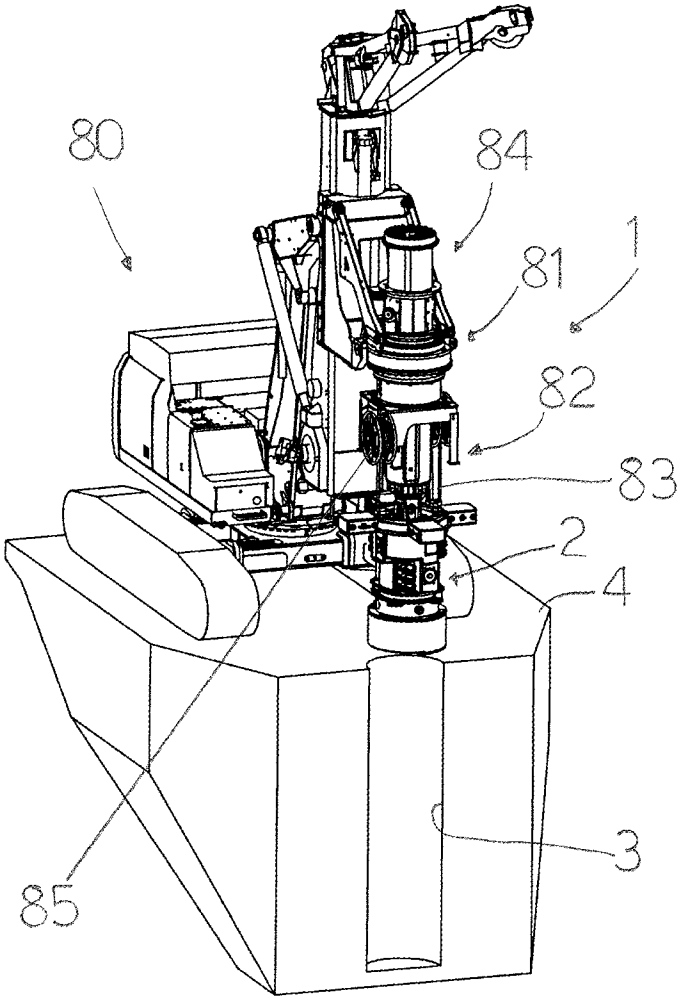
FIG. 2 is a perspective view of a rock crushing machine of known type which comprises a rock crushing unit in accordance with a first embodiment of the invention; and of a portion of rocky terrain in section, in which a pilot hole to be widened is made.

The pilot hole (3) is a hole that has been made previously on rocky terrain (4) using known modalities, see FIG. 2. The pilot hole (3) can have a diameter starting from about 700 mm-1000 mm. This diameter has been chosen so as to reduce the number of compressors eventually necessary for realising the pilot hole and to enable the main body (2) to insert therein.

The rotation velocity of the main body (2) can be 20 revolutions per minute and the modalities for drawing the main body (2) in rotation are generally of known type.

When the arms of the first plurality of arms (51) are in a retracted position (R), the main body (2) can be inserted in the pilot hole (3).

The crushing elements of the first plurality of crushing elements (21) can comprise roller bits, FIGS. 2-9: as is known, a roller bit comprises a truncoconical portion provided with crushing buttons. Each roller bit is preferably arranged so that the relative axis is inclined with respect to the lateral wall of pilot hole (3); see for example FIGS. 4B, 9B.

These crushing elements of the first plurality of crushing elements (21) can comprise cutter discs (FIGS. 10-11): a cutter disc, as is known, comprises a disc (or plurality of discs one above another and solidly constrained to one another, for example in a single body) which is peripherally provided with cutting tips.

These crushing elements of the first plurality of crushing elements (21) can comprise crushing rollers, not illustrated: a crushing roller comprises a cylindrical portion provided with crushing buttons. Each crushing roller is preferably arranged so that the relative axis is parallel to the axis of the pilot hole (3).

The rock crushing unit (1) can also comprise a second plurality of crushing elements (22) for crushing rock, each of which is borne by an arm of the first plurality of arms (51) and is arranged in order to be able to press against the lateral wall of the pilot hole (3) during use of the rock crushing unit (1). These crushing elements of the second plurality of crushing elements (22) can comprise rock picks, see FIGS. 10-11.

Each crushing element (21) of the first plurality of crushing elements is preferably rotoidally coupled to a corresponding arm of the first plurality of arms (51), and is thus free to rotate with respect to an axis thereof.

In accordance with a first embodiment of the rock crushing unit (1), each arm of the first plurality of arms (51) comprises a rod (6) (FIG. 4B) of a hydraulic cylinder of the plurality of hydraulic cylinders (55); the hydraulic cylinders of the plurality of hydraulic cylinders (55) are angularly equidistanced from one another so that the reaction forces which are generated when the crushing unit is in use mutually compensate; each crushing element of the first plurality of crushing elements (21) is arranged at the free end of a rod (6) of a hydraulic cylinder of the plurality of hydraulic cylinders (55).

If the hydraulic cylinders are two in number, they can be arranged at 180° from one another; if the hydraulic cylinders are three in number, they can be arranged at 120° to one another; if the hydraulic cylinders are four in number, they can be arranged at 90° to one another; and so on.

In the case illustrated in the figures of the drawings, the rock crushing unit (1) comprises a first pair of hydraulic cylinders (31) which is arranged at a first height and a second pair of hydraulic cylinders (32), which is arranged at a second height: the hydraulic cylinders of each pair of hydraulic cylinders are however arranged opposite one another, i.e. arranged at an angle of 180°.

When the crushing elements of the first plurality of crushing elements (21) (or the crushing element, if only one is provided) borne by a rod (6) of a hydraulic cylinder of the plurality of hydraulic cylinders (55) press against the lateral wall of the pilot hole (3) then a corresponding reaction force is generated, in an opposite direction: the fact that the cylinders of the plurality of hydraulic cylinders (55) are angularly equidistanced from one another is advantageous, as the reaction forces generated by the rods (6) of each cylinder of the plurality of hydraulic cylinders (55) thus tend to reciprocally compensate.

The hydraulic cylinders of the plurality of hydraulic cylinders (55) are preferably double-acting, so that the return of the rods (6) of the hydraulic cylinders is easy once the pilot hole (3) has been widened.

Once the rock crushing unit (1) has widened the pilot hole (3) where the crushing elements of the first plurality of crushing elements (21) have been active (see FIGS. 2, 3, 4), then the hydraulic cylinders of the plurality of hydraulic cylinders (55) can retract the rods (6) and the rock crushing unit (1) can be moved along the axis of the pilot hole (3) to widen the pilot hole (3) in another zone having a different depth in which the pilot hole (3) still has its original diameter. FIG. 5 shows the rock crushing unit (1) after it has widened the pilot hole (3) up to a first diameter and to a determined depth.

Each arm of the first plurality of arms (51) can comprise (FIG. 4B) a plate (7) which is fixed to the end of a corresponding rod (6), which is orientated perpendicularly to the axis of the rod (6) and to which one or more crushing elements of the first plurality of crushing elements (21) have been fixed (in FIGS. 2-9 these are three in number).

Figure 7:
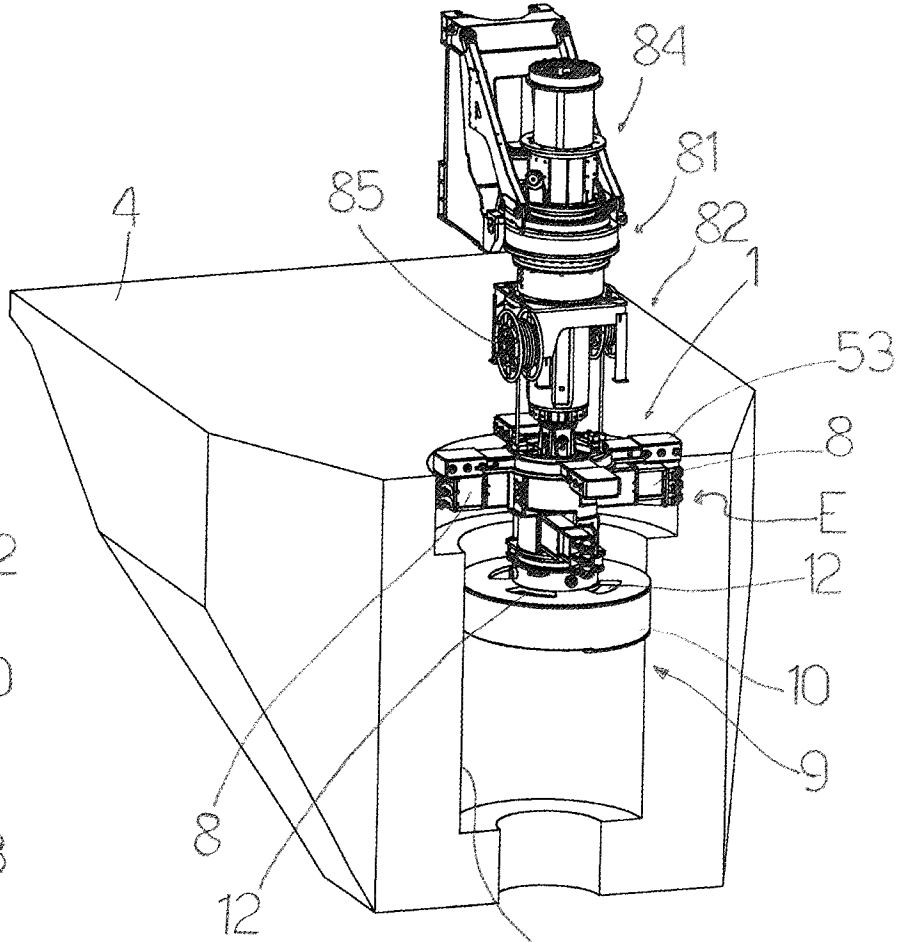
FIG. 7 is a perspective view of a part of the rock crushing machine illustrated in FIG. 6 during a fifth step of widening the pilot hole up to the second diameter; and of the portion of rocky terrain in section view of FIG. 2.
Figure 6:
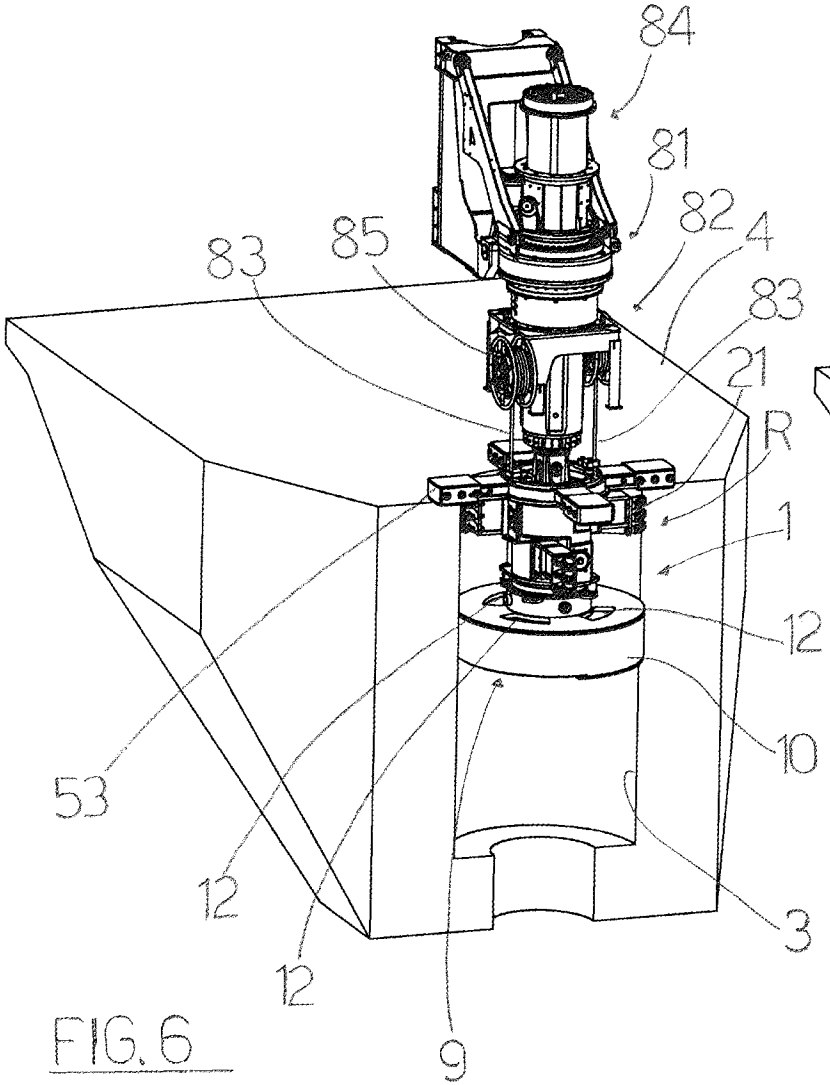
FIG. 6 is a perspective view of a part of the rock crushing machine of FIG. 2 during a fourth step of widening the pilot hole up to a second diameter larger than the first diameter, in which the rock crushing unit uses a basket of greater dimensions; and of the portion of rocky terrain in section view of FIG. 2.
Figures 8A, 8B, 9A, 9B:
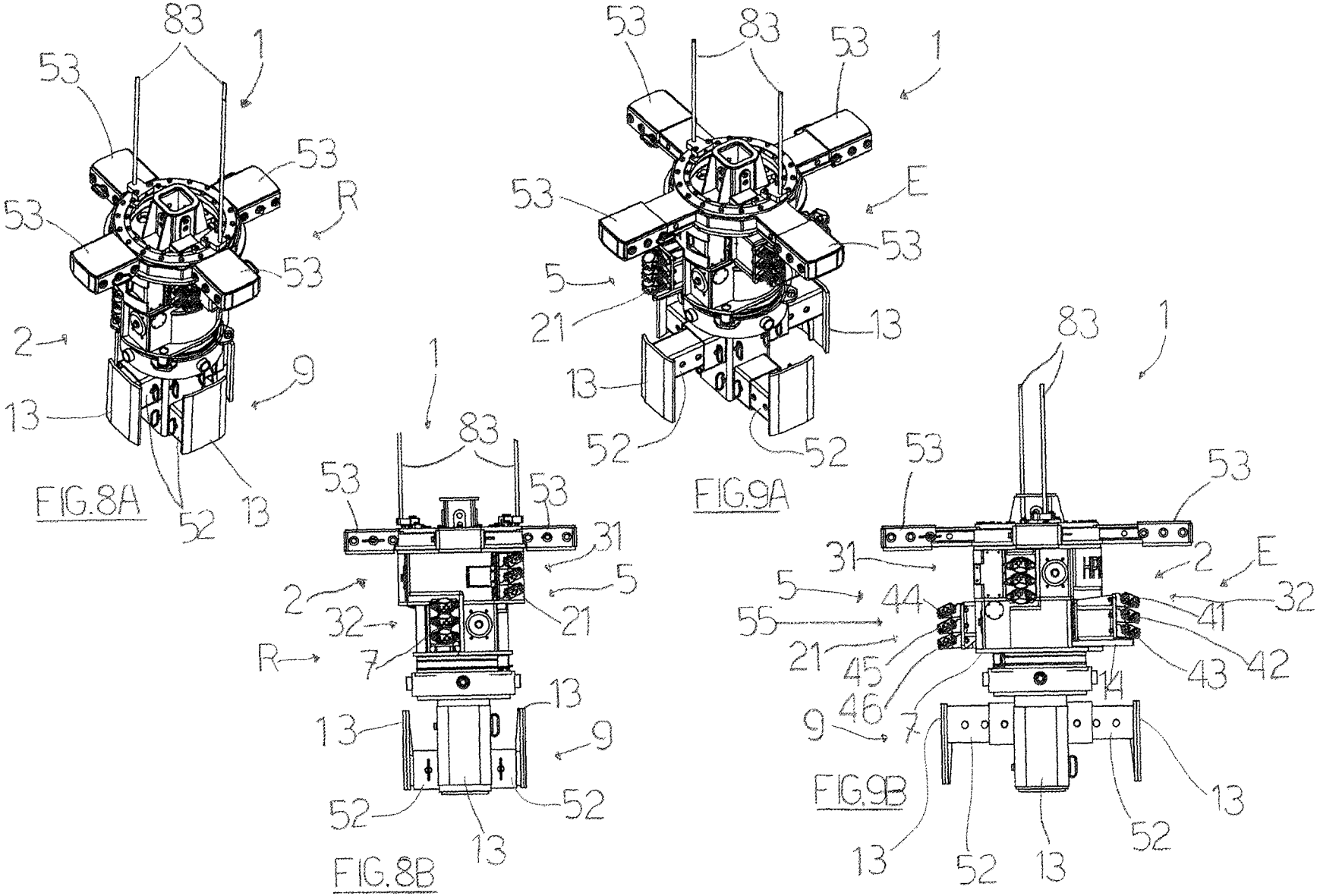
FIGS. 8A, 8B are respectively a perspective view and a lateral view of the rock crushing unit of FIG. 2 in which the basket has been replaced by a plurality of abutment plates that are in a first operating configuration to abut the lateral wall of the pilot hole.
FIGS. 9A, 9B are respectively a perspective view and a lateral view of the rock crushing unit of FIGS. 8A, 8B in which the plurality of abutment plates are in a second operating configuration to abut the lateral wall of the pilot hole after the pilot hole has been widened to reach the first diameter.

To further widen to the pilot hole (3) from the first diameter to a second diameter which is greater than the first diameter, FIGS. 6, 7, the rock crushing unit (1) can comprise a plurality of extensions (8) for arms. Each extension of the plurality of extensions (8) is fixable to a rod (6) of a hydraulic cylinders of the plurality of hydraulic cylinders (55) and can bear one or more crushing elements of the first plurality of crushing elements (21). For example, it is possible to decouple the plate (7) with the crushing elements of the first plurality of crushing elements (21) from the rod (6) (the plate (7) and crushing elements of the first plurality of crushing elements (21) are clearly visible in FIG. 4B), fix the plate (7) with the crushing elements of the first plurality of crushing elements (21) to the extension (8) and fix the extension (8) to the rod (6). In this way, for example, when the rods (6) of the hydraulic cylinders of the plurality of hydraulic cylinders (55) are retracted, the crushing elements of the first plurality of crushing elements (21) can operate against the lateral wall of the pilot hole (3) having the first diameter (FIG. 6); once the pilot hole (3) has been widened to reach the second diameter, the rods (6) of the hydraulic cylinders of the plurality of hydraulic cylinders (55) can be extended (FIG. 7).

At least a part of the crushing elements (see FIG. 9) of the crushing elements of the first plurality of crushing elements (21) borne by an arm of the first plurality of arms (51) is preferably arranged at different heights with respect to at least a part of the crushing elements of the first plurality of crushing elements (21) borne by another arm of the first plurality of arms (51) so that, overall, the crushing elements of the first plurality of crushing elements (21) are able to remove a single cylindrical volume of material from the lateral wall of the pilot hole (3) when the main body (2) is inserted in the pilot hole (3) and is stationary at a depth. In other words, the crushing elements of the first plurality of crushing elements (21) borne by an arm of the first plurality of arms (51) can be staggered in height with respect to the crushing elements borne by another arm of the first plurality of arms (51), so that a crushing element of one arm can be interposed, in height, between two crushing elements of another arm.

For example, a rod (6) of a first hydraulic cylinder of the plurality of hydraulic cylinders (55) can bear a first crushing element (41), a second crushing element (42) and a third crushing element (43), while the rod (6) of a second hydraulic cylinder of the plurality of hydraulic cylinders (55) can bear a fourth crushing element (44), a fifth crushing element (45) and a sixth crushing element (46). All of these crushing elements are arranged at staggered and consecutive heights to one another, in the sense that: the first crushing element (41) is higher than the fourth crushing element (44); the fourth crushing element (44) is higher than the second crushing element (42); the second crushing element (42) is higher than the fifth crushing element (45); the fifth crushing element (45) is higher than the third crushing element (43); the third crushing element (43) is higher than the sixth crushing element (46) (see FIGS. 4B, 9B). If the hydraulic cylinders of the plurality of hydraulic cylinders (55) are only two in number, then all the above-mentioned crushing elements concur to remove a single volume of rocky material. In this way, once the pilot hole (3) has been widened to the desired diameter, the rock crushing unit (1) can be lowered to a greater depth to newly widen the pilot hole (3).

The rock crushing unit (1) preferably comprises stabilising means (9) borne by the main body (2), and which are configured to be able to abut the lateral wall of the pilot hole (3) with the aim of keeping the main body (2) centred with respect to the axis of the pilot hole (3) during use of the rock crushing unit (1).

The stabilising means (9) have advantageously been designed to exploit the pilot hole (3) as a centring guide of the main body (2).

The stabilising means (9) preferably comprise a cylindrical body (10) which is dimensioned so as to insert in the pilot hole (3) and to abut the lateral wall of the pilot hole (3). Still more preferably, the cylindrical body (10) is a basket (10) for collection of rocky material which is arranged inferiorly of the first plurality of crushing elements (21) and which comprises at least an opening (12) so as to internally receive the rocky material which is progressively removed from the lateral wall of the pilot hole (3). Therefore the rock crushing unit (1) must be periodically withdrawn from the pilot hole (3) in order to unload the rocky material present in the basket (10). FIGS. 2-5 show a basket (10) having a diameter just smaller than the diameter of the pilot hole (3) to be widened. After the pilot hole (3) has been widened up to the first diameter, FIG. 6, the basket (10) can be replaced with one having a larger diameter and slightly smaller than the first diameter (see FIGS. 6 and 7).

Alternatively, the stabilising means (9) comprise, instead of the above-described basket (10), a plurality of abutments (13) for abutting the lateral wall of the pilot hole (3): the distance of the plurality of abutments (13) from the axis of the main body (2) is adjustable so as to adapt the stabilising means (9) to different diameters of the pilot hole (3). In this regard, see FIGS. 8A, 8B in which the abutments of the plurality of abutments (13) are distanced from one another by a little less than the original diameter of the pilot hole (3) to be widened, and FIGS. 9A, 9B, in which the abutments of the plurality of abutments (13) are distanced from one another by a little less than the first diameter of the pilot hole (3).

The stabilising means (9) preferably comprise a second plurality of arms (52) which are arranged radially, which are telescopic and which bear the abutments of the plurality of abutments (13). Each abutment of the plurality of abutments (13) is preferably arranged at the free end of an arm of the second plurality of arms (52). The abutments of the plurality of abutments (13) are preferably angularly equidistanced to one another. The abutments of the plurality of abutments (13) are preferably plates; these plates can be arched (FIGS. 8A, 9A) to adapt to the curvature of the lateral wall of the pilot hole (3).

The stabilising means (9) are preferably rotatable and borne by the main body (2). During the use of the rock crushing unit (1), the rocky material which is progressively crushed can be not uniform, with the consequence that the main body (2) tends to displace from the axis of the pilot hole (3) towards the area of rocky material which is more easily crushed: to keep the main body (2) centred, the stabilising means (9) abut the pilot hole (3), generating friction. In such a circumstance, the stabilising means (9) are solidly constrained to the main body (2), then the friction generated by contact of the stabilising means (9) with the lateral wall of the pilot hole (3) gives rise to a resistant torque that is opposite to the activating torque of the main body (2). To prevent this drawback, the stabilising means (9) can advantageously be rotatable and borne by the main body (2), i.e. can be idle.

The rock crushing unit (1) preferably comprises deflecting means (14) (FIGS. 3A, 4A), which are borne by the first plurality of arms (51), which are lower than the first plurality of arms (51) and which are designed to deflect the rocky material which is progressively removed by the crushing elements of the first plurality of crushing elements (21) towards the axis of the pilot hole (3) when the rock crushing unit (1) is in use. The rocky material, progressively crushed, is thus advantageously conveyed towards the underlying mouth of the pilot hole (3). If the rock crushing unit (1) comprises a basket (10) for collecting the rocky material that is borne by the main body (2) and which is arranged inferiorly of the main body (2), then the rocky material can be collected in the basket (10) and periodically be unloaded to the outside by raising the rock crushing unit (1). If there is no basket (10), the rocky material can be conveyed to inside the pilot hole (3) in order to then be collected using known methods, so as not to obstruct the functioning of the rock crushing unit (1).

The deflecting means (14) preferably comprise a plurality of blades (14). The blades of the plurality of blades (14) can be fixed to the lower walls of the arms of the first plurality of arms (51), for example by welding.

The rock crushing unit (1) preferably comprises a third plurality of arms (53) (FIGS. 2-9), which are rotatable and borne by the main body (2), which are arranged superiorly of the main body (2) and which project from the main body (2) so as to inferiorly abut the rocky material to be removed. The arms of the third plurality of arms (53) are preferably extensible, still more preferably telescopic. The arms of the third plurality of arms (53) can form a four-arm cross arranged at 90° to each other.

Figure 10A:
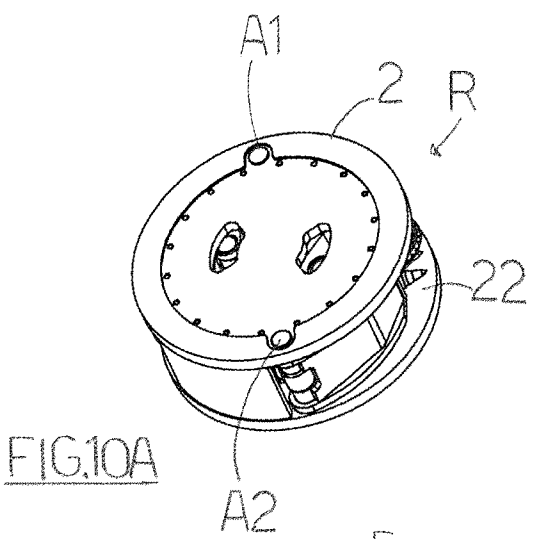
FIGS. 10A-10C are three perspective views showing a first variant of the detail illustrated in FIG. 4B, in three operating configurations.
Figure 10B:
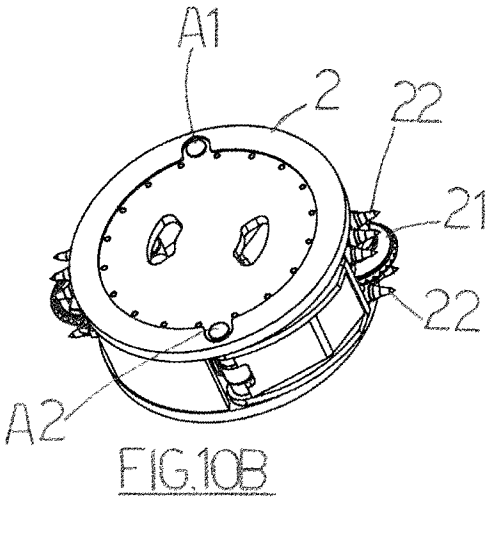
Figure 10C:
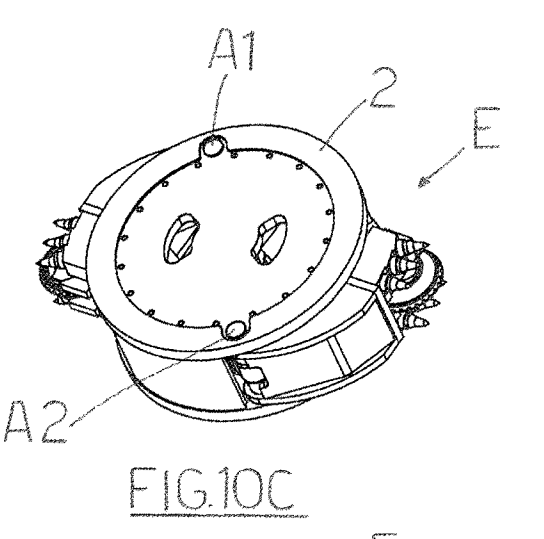
Figure 10D:
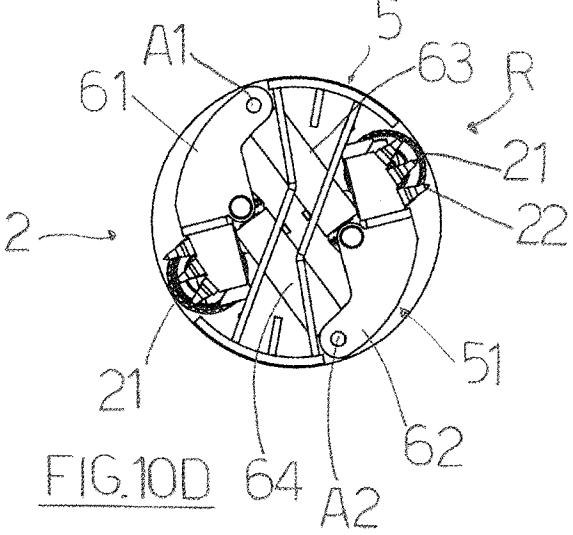
FIGS. 10D-10F are transversal section views respectively of the detail illustrated in FIGS. 10A-10C.
Figure 10E:
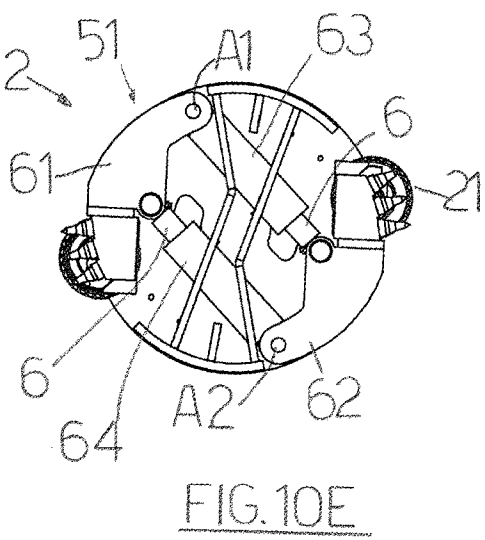
Figure 10F:
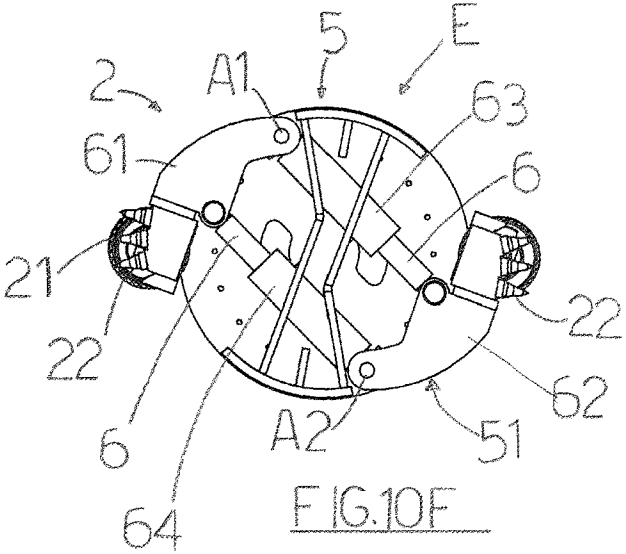

In a second embodiment of the rock crushing unit (1), illustrated in FIGS. 10A-10F: the first plurality of arms (51) comprises a first arm (61) and a second arm (62); the first arm (61) is rotatably coupled to the main body (2) at a first hinge axis (A1); the second arm (62) is rotatably coupled to the main body (2) at a second hinge axis (A2); the first actuator means (5) comprise a first hydraulic cylinder (63) and a second hydraulic cylinder (64); the first hydraulic cylinder (63) comprises a jacket which is rotatably coupled to the main body (2) at the first hinge axis (A1), and a rod (6) which is rotatably coupled to the second arm (62) so that the first hydraulic cylinder (63) can move the second arm (62) between the retracted position (R) (FIGS. 10A, 10D) and the extended position (E) (FIGS. 10C, 10F); the second hydraulic cylinder (64) comprises a jacket which is rotatably coupled to the main body (2) at the second hinge axis (A2), and a rod (6) which is rotatably coupled to the first arm (61) so that the second hydraulic cylinder (64) can move the first arm (61) between the retracted position (R) (FIGS. 10A, 10D) and the extended position (E) (FIGS. 10C, 10F). In the example illustrated in FIGS. 10A-10F the crushing elements of the first plurality of crushing elements (21) comprise cutter discs; further, the rock crushing unit (1) comprises crushing elements of the second plurality of crushing elements (22) which comprise rock picks. The rod (6) of the first hydraulic cylinder (63) can be rotatably coupled to the second arm (62) at an intermediate portion of the second arm (62), while the rod (6) of the second hydraulic cylinder (64) can be rotatably coupled to the first arm (61) at an intermediate portion of the first arm (61).

The rock crushing unit (1) according to the second invention comprises: a main body (2) dimensioned so as to insert in a pilot hole (3) realised on rocky terrain (4) and activatable in rotation with respect to the axis thereof; first actuator means (5) which are borne by the main body (2) and which comprise a hydraulic cylinder (55, 63, 64); an arm (51) which is borne by the main body (2) and which is activatable by the hydraulic cylinder (55, 63, 64) in order to move between a retracted position (R) and an extended position (E) with a planar movement that is perpendicular to the axis of the main body (2); a first plurality of crushing elements (21) for crushing rock, each of which is borne by the arm, is rotatable with respect to the cited arm and is arranged in order to be able to press against, and roll along, the lateral wall of the pilot hole (3) during use of the rock crushing unit (1), i.e. when the main body (2) is inserted in the pilot hole (3) and is drawn in rotation with respect to the axis thereof and when the hydraulic cylinder (55, 63, 64) activates the arm so that it moves towards the extended position (E); stabilising means (9) borne by the main body (2) and which are configured to be able to abut the lateral wall of the pilot hole (3) with the aim of keeping the main body (2) centred with respect to the axis of the pilot hole (3) during use of the rock crushing unit (1); the rock crushing unit (1) being configured so that when in use, the action exerted by the crushing elements of the first plurality of crushing elements (21) on the lateral wall of the pilot hole (3) determines the crushing of the lateral wall of the pilot hole (3) and thus the widening of the pilot hole (3).

The first actuator means (5) preferably comprise a plurality of hydraulic cylinders (55, 63, 64); the rock crushing unit (1) comprises a first plurality of arms (51) which are borne by the main body (2) and which are activatable by the hydraulic cylinders of the plurality of hydraulic cylinders (55, 63, 64) in order each to move between a retracted position (R) and an extended position (E) with a planar movement which is perpendicular to the axis of the main body (2); each crushing element of the first plurality of crushing elements (21) is rotatable and borne by an arm of the first plurality of arms (51) and is arranged in order to be able to press against, and roll along, the lateral wall of the pilot hole (3) during use of the rock crushing unit (1), i.e. when the main body (2) is inserted in the pilot hole (3) and is drawn in rotation with respect to the axis thereof and when the hydraulic cylinders of the plurality of hydraulic cylinders (55, 63, 64) activate the first plurality of arms (51) so that they move towards the extended position (E).

All the considerations already elaborated for the first invention are also valid for the second invention.

A further aim of the present invention is rock crushing method for widening a pilot hole (3) realised on rocky terrain (4), comprising following steps: bringing a first plurality of crushing elements (21) to crush rock internally of a pilot hole (3) realised on rocky terrain (4); pressing the crushing elements of the first plurality of crushing elements (21) against the lateral wall of the pilot hole (3) and at the same time causing the crushing elements of the first plurality of crushing elements (21) to roll along a cylindrical portion of the lateral wall of the pilot hole (3), so that the action exerted by the crushing elements of the first plurality of crushing elements (21) on the lateral wall of the pilot hole (3) determines the crushing of the lateral wall of the pilot hole (3) and thus the widening of the pilot hole (3).

The hole obtained can have various shapes, for example cylindrical or conical.

The method preferably includes repeating the previous steps, taking the first plurality of crushing elements (21) to different depths, so that overall a cylindrical volume of rocky material is removed.

The rock crushing unit (1) according to the first invention and the second invention is part of a rock crushing machine (80), see FIG. 2. The rock crushing machine (80) can comprise: a supply source of hydraulic oil (not illustrated); a hydraulic joint (81) for passage of hydraulic oil towards and away from the hydraulic cylinders (55, 63, 64) (first and third embodiments of the rock crushing unit (1)) borne by the main body (2); second actuator means (82) for drawing the main body (2) in rotation; hydraulic tubes (83) which are connected to the hydraulic cylinders (55, 63, 64) borne by the main body (2); raising means (84) for raising and lowering the rock crushing unit (1); one or more winders (85) (two in the figures) which are solidly constrained to the main body (2) to envelop the hydraulic tubes (83) when the rock crushing unit (1) is raised or to unwind the hydraulic tubes (83) as the rock crushing unit (1) is progressively lowered.

The following is a description of the rock crushing unit (1) illustrated in FIGS. 2-7.

FIG. 2 illustrates the pilot hole (3) realised on rocky terrain (4), having an original diameter. Each rod (6) of a hydraulic cylinder of the plurality of hydraulic cylinders (55) is in the retracted position (R), FIG. 2A.

Figure 3A:
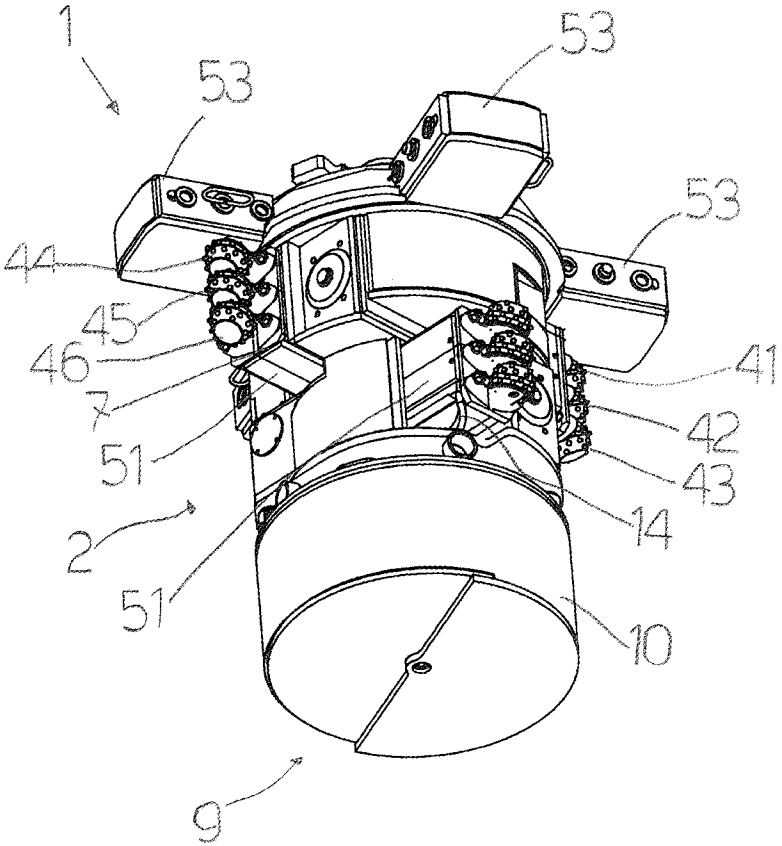
FIG. 3A is a perspective view of the rock crushing unit of FIG. 2 in a second operating configuration.
Figure 3:
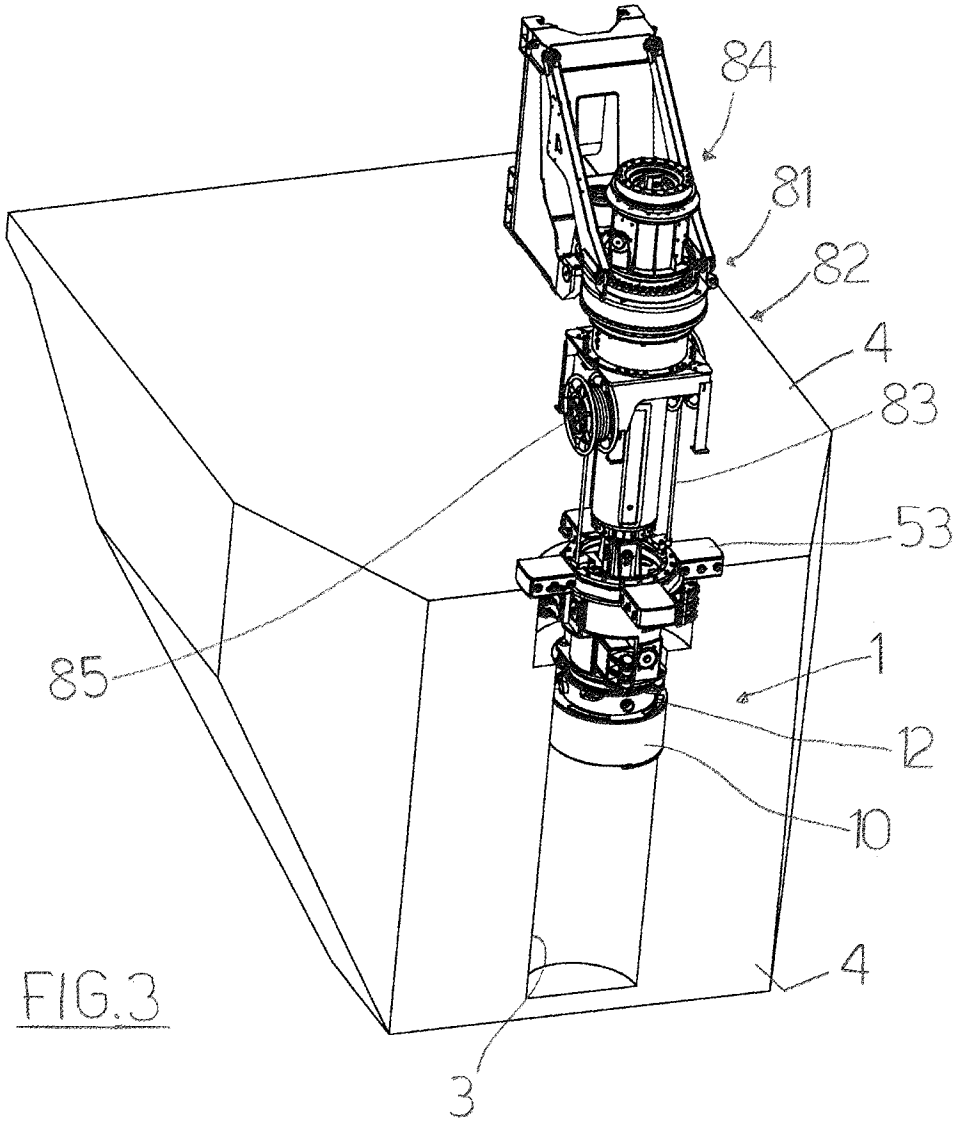
FIG. 3 is a perspective view of a part of the rock crushing machine of FIG. 2 during a first step of widening the pilot hole up to a first diameter; and of the portion of rocky terrain in section view of FIG. 2.

Thereafter, FIG. 3, the rock crushing unit (1) is lowered to a first depth (immediately below the level of the terrain) so that the main body (2) inserts in the pilot hole (3) until the third plurality of arms (53) (i.e. the cross) abuts against the rocky material to be removed, which forms the edges of the pilot hole (3): then, the main body (2) is drawn in rotation with respect to the axis thereof and the hydraulic cylinders of the plurality of hydraulic cylinders (55) are activated to take the relative rods (6) towards the extended position (E), with the consequence that the roller bits press against, and roll along, the lateral wall of the pilot hole (3), and start to crush it and widen the pilot hole (3). FIG. 3A shows how each rod (6) of a hydraulic cylinder of the plurality of hydraulic cylinders (55) is in a position comprised between the retracted position (R) and the extended position (E).

Figure 4A:
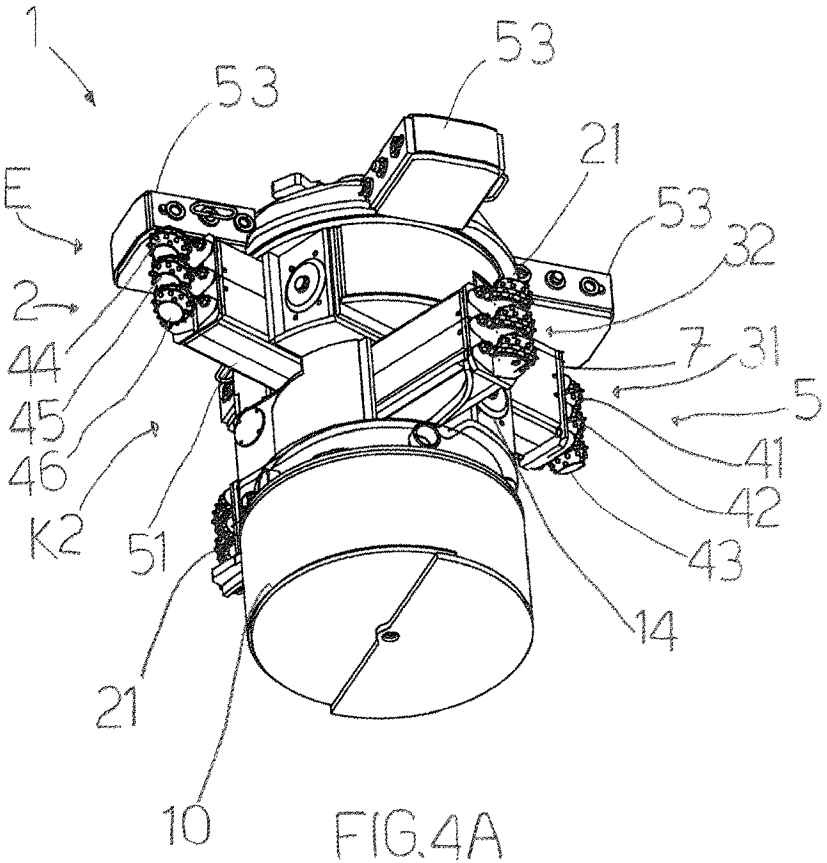
FIG. 4A is a perspective view of the rock crushing unit of FIG. 2 in a third operating configuration.
Figure 4:
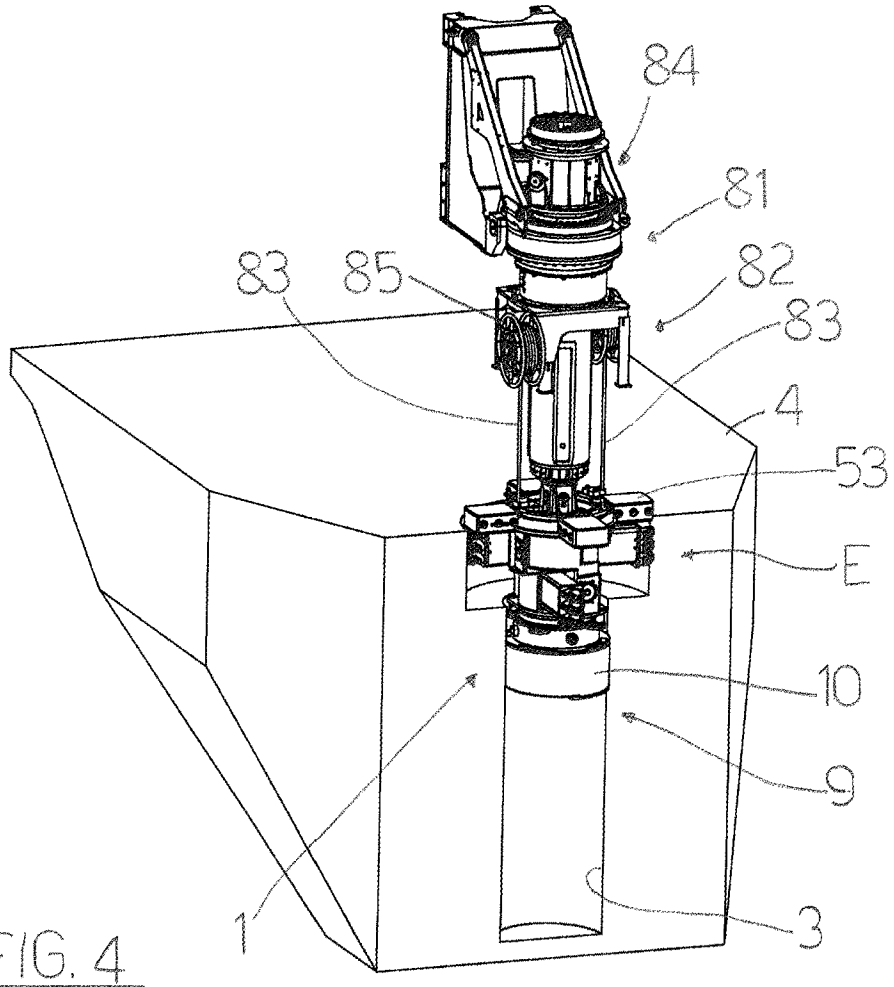
FIG. 4 is a perspective view of a part of the rock crushing machine of FIG. 2 during a second step of widening the pilot hole up to the first diameter; and of the portion of rocky terrain in section view of FIG. 2.
Figure 4B:
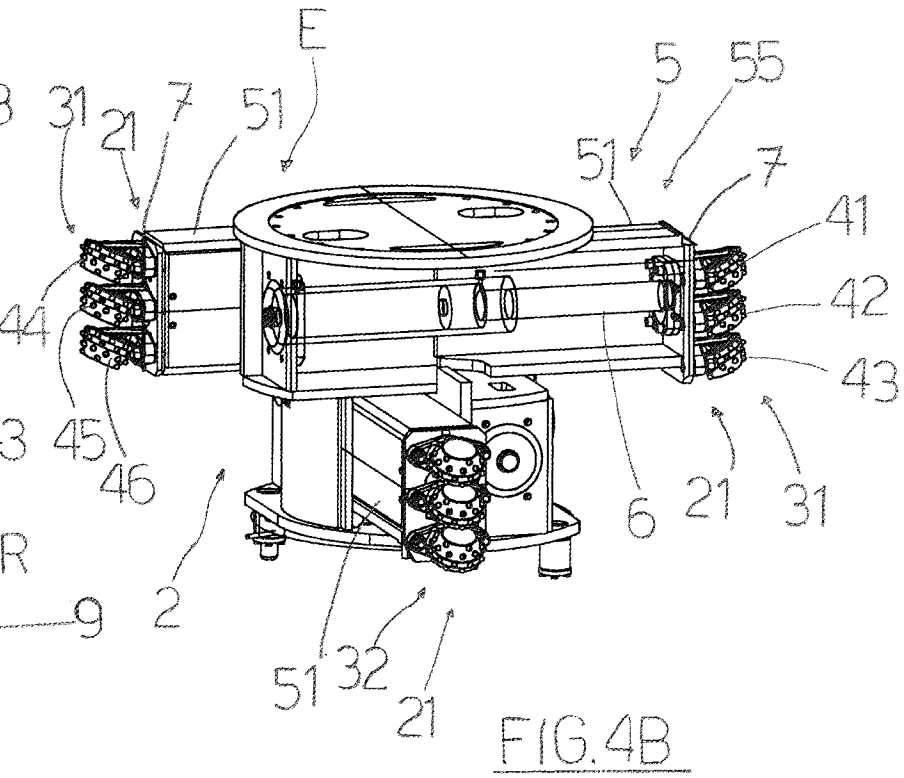
FIG. 4B is a perspective view of the larger-scale detail K2 of FIG. 4A, partly-sectioned.
Figure 5:
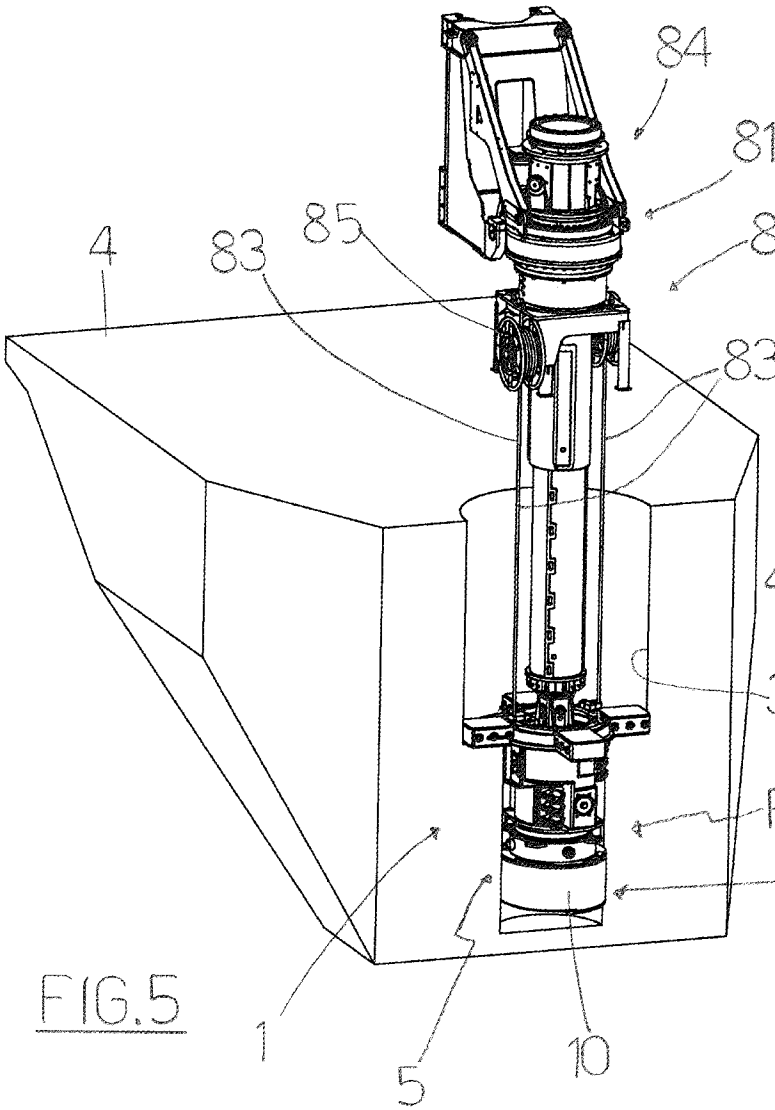
FIG. 5 is a perspective view of a part of the rock crushing machine of FIG. 2 during a third step of widening the pilot hole up to the first diameter; and of the portion of rocky terrain in section view of FIG. 2.

FIG. 4 shows that at the first depth the rock crushing unit (1) has widened the pilot hole (3) from the original diameter up to a first diameter; the rods (6) of the hydraulic cylinders of the plurality of hydraulic cylinders (55) have reached the extended position (E). In general terms, the first diameter (which is a predetermined value) can be reached even when the rods (6) of the hydraulic cylinders of the plurality of hydraulic cylinders (55) have reached a position comprised between the retracted position (R) and the extended position (E).

Subsequently, the rock crushing unit (1) is lowered to a further depth and the above-described cycle is repeated.

FIG. 5 shows the rock crushing unit (1) at a determined depth and which is ready to remove rocky material, to take the pilot hole (3) from the original diameter up to the first diameter.

In a case where the rods (6) of the hydraulic cylinders of the plurality of hydraulic cylinders (55) are too short to obtain a desired final diameter of the pilot hole (3), then extensions (8) for the arms can be fitted, to be fixed to the rods (6) of the hydraulic cylinders of the plurality of hydraulic cylinders (55), see FIG. 6, so as to bring the diameter of the pilot hole (3) from the first diameter to the second diameter. In this case it is necessary also to replace the basket (10) with one of bigger dimensions and lengthen the arms of the third plurality of arms (53).

FIG. 7 shows the pilot hole (3) widened up to the second diameter at the first depth.

In general terms, the second diameter (which is also a predetermined value) can be reached even when the rods (6) of the hydraulic cylinders of the plurality of hydraulic cylinders (55), on which the extensions (8) have been fitted, have reached a position comprised between the retracted position (R) and the extended position (E).

It is understood that the foregoing has been described by way of non-limiting example, and that any eventual constructional variations are understood to fall within the protective scope of the present technical solution, as claimed in the following.

The invention claimed is:

1. A rock crushing unit for widening a pilot hole realised on rocky terrain, comprising:

a main body with a rotation axis dimensioned so as to insert in the pilot hole realised on rocky terrain and activatable in rotation with respect to the rotation axis;

first actuator means which are borne by the main body and which comprise a plurality of hydraulic cylinders;

a first plurality of arms which are borne by the main body and which are activatable by the hydraulic cylinders of the plurality of hydraulic cylinders in order each to move between a retracted position and an extended position with a planar movement that is perpendicular to the rotation axis of the main body;

a first plurality of crushing elements for crushing rock, each of which is borne by an arm of the first plurality of arms, is rotatable with respect to a respective arm of the first plurality of arms and is arranged in order to be able to press against, and roll along, a lateral wall of the pilot hole during use of the rock crushing unit, i.e. when the main body is inserted in the pilot hole and is drawn in rotation with respect to the rotation axis and when the hydraulic cylinders of the plurality of hydraulic cylinders activate the first plurality of arms so that they move towards the extended position;

the rock crushing unit being configured so that when in use, the action exerted by the crushing elements of the first plurality of crushing elements on the lateral wall of the pilot hole determines the crushing of the lateral wall of the pilot hole and thus the widening of the pilot hole; and the arms of the first plurality of arms being arranged in such a way that when the crushing unit is in use, the reaction forces which are generated on the arms of the first plurality of arms, and which are due to the pressure exerted by the crushing elements of the first plurality of crushing elements on the lateral wall of the pilot hole, compensate one another, wherein the first plurality of arms comprises a first arm and a second arm;

the first arm is rotatably coupled to the main body at a first hinge axis;

the second arm is rotatably coupled to the main body at a second hinge axis;

the first actuator means comprise a first hydraulic cylinder and a second hydraulic cylinder;

the first hydraulic cylinder comprises a jacket which is rotatably coupled to the main body at the first hinge axis, and a rod which is rotatably coupled to the second arm so that the first hydraulic cylinder can move the second arm between the retracted position and the extended position; and the second hydraulic cylinder comprises a jacket which is rotatably coupled to the main body at the second hinge axis, and a rod which is rotatably coupled to the first arm so that the second hydraulic cylinder can move the first arm between the retracted position and the extended position.

2. The rock crushing unit of claim 1, comprising stabilising means borne by the main body, and which are configured to be able to abut the lateral wall of the pilot hole with the aim of keeping the main body centred with respect to the axis of the pilot hole during use of the rock crushing unit.

3. The rock crushing unit of claim 1, wherein:

each arm of the first plurality of arms comprises a rod of a hydraulic cylinder of the plurality of hydraulic cylinders;

the hydraulic cylinders of the plurality of hydraulic cylinders are angularly equidistanced from one another so that the reaction forces mutually compensate;

each crushing element of the first plurality of crushing elements is arranged at a free end of the rod of the hydraulic cylinder of the plurality of hydraulic cylinders.

4. The rock crushing unit of claim 1, wherein at least a part of the crushing elements borne by an arm of the first plurality of arms are arranged at different heights with respect to at least a part of the crushing elements borne by another arm of the first plurality of arms so that, overall, the crushing elements of the first plurality of crushing elements are able to remove a single cylindrical volume of material from the lateral wall of the pilot hole when the main body is inserted in the pilot hole and is stationary at a depth.

5. The rock crushing unit of claim 1, comprising deflecting means, which are borne by the first plurality of arms, which are lower than the first plurality of arms and which are designed to deflect the rocky material which is progressively removed by the crushing elements of the first plurality of crushing elements towards the axis of the pilot hole when the rock crushing unit is in use.

6. A rock crushing unit for widening a pilot hole realised on rocky terrain, comprising:

a main body with a rotation axis dimensioned so as to insert in the pilot hole realised on rocky terrain and activatable in rotation with respect to the rotation axis;

first actuator means which are borne by the main body and which comprise a hydraulic cylinder;

an arm which is borne by the main body and which is activatable by the hydraulic cylinder in order to move between a retracted position and an extended position with a planar movement that is perpendicular to the rotation axis of the main body;

a first plurality of crushing elements for crushing rock, each of which is borne by the arm, is rotatable with respect to the respective arm and is arranged in order to be able to press against, and roll along, a lateral wall of the pilot hole during use of the rock crushing unit, i.e. when the main body is inserted in the pilot hole and is drawn in rotation with respect to the rotation axis and when the hydraulic cylinder activates the arm so that it moves towards the extended position;

stabilising means borne by the main body and which are configured to be able to abut the lateral wall of the pilot hole to keep the main body centred with respect to the axis of the pilot hole during use of the rock crushing unit; and the rock crushing unit being configured so that when in use, the action exerted by the crushing elements of the first plurality of crushing elements on the lateral wall of the pilot hole determines the crushing of the lateral wall of the pilot hole and thus the widening of the pilot holes, wherein: the first actuator means comprise a plurality of hydraulic cylinders;

the rock crushing unit comprises a first plurality of arms which are borne by the main body and which are activatable by the hydraulic cylinders of the plurality of hydraulic cylinders in order each to move between a retracted position and an extended position with a planar movement which is perpendicular to the rotation axis of the main body;

each crushing element of the first plurality of crushing elements is rotatable and borne by an arm of the first plurality of arms and is arranged in order to be able to press against, and roll along, the lateral wall of the pilot hole during use of the rock crushing unit, i.e. when the main body is inserted in the pilot hole and is drawn in rotation with respect to the rotation axis and when the hydraulic cylinders of the plurality of hydraulic cylinders activate the first plurality of arms so that they move towards the extended position, wherein: the first plurality of arms comprises a first arm and a second arm;

the first arm is rotatably coupled to the main body at a first hinge axis;

the second arm is rotatably coupled to the main body at a second hinge axis;

the first actuator means comprise a first hydraulic cylinder and a second hydraulic cylinder;

the first hydraulic cylinder comprises a jacket which is rotatably coupled to the main body at the first hinge axis, and a rod which is rotatably coupled to the second arm so that the first hydraulic cylinder can move the second arm between the retracted position and the extended position; and the second hydraulic cylinder comprises a jacket which is rotatably coupled to the main body at the second hinge axis, and a rod which is rotatably coupled to the first arm so that the second hydraulic cylinder can move the first arm between the retracted position and the extended position.

7. The rock crushing unit of claim 6, wherein the stabilising means are rotatable and borne by the main body.

8. The rock crushing unit of claim 6, wherein the stabilising means comprise a plurality of abutments for abutting the lateral wall of the pilot hole, the distance of the abutments from the rotation axis of the main body being adjustable so as to adapt the stabilising means to different diameters of the pilot hole.

9. The rock crushing unit of claim 6, wherein the stabilising means comprise a cylindrical body which is dimensioned so as to insert in the pilot hole and to abut the lateral wall of the pilot hole.

10. The rock crushing unit of the claim 9, wherein the cylindrical body is a basket for collection of rocky material which is arranged inferiorly of the first plurality of crushing elements and which comprises at least an opening so as to internally receive the material which is progressively removed from the lateral wall of the pilot hole.

11. The rock crushing unit of claim 6, wherein: each arm of the first plurality of arms comprises a rod of a hydraulic cylinder of the plurality of hydraulic cylinders;

the hydraulic cylinders of the plurality of hydraulic cylinders are angularly equidistanced from one another so that the reaction forces mutually compensate;

each crushing element of the first plurality of crushing elements is arranged at the free end of a rod of a hydraulic cylinder of the plurality of hydraulic cylinders.

12. The rock crushing unit of claim 6, wherein at least a part of the crushing elements borne by an arm of the first plurality of arms are arranged at different heights with respect to at least a part of the crushing elements borne by another arm of the first plurality of arms so that, overall, the crushing elements of the first plurality of crushing elements are able to remove a single cylindrical volume of material from the lateral wall of the pilot hole when the main body is inserted in the pilot hole and is stationary at a depth.

13. The rock crushing unit of claim 6, comprising deflecting means, which are borne by the first plurality of arms, which are lower than the first plurality of arms and which are designed to deflect the rocky material which is progressively removed by the crushing elements of the first plurality of crushing elements towards the axis of the pilot hole when the rock crushing unit is in use.

14. The rock crushing unit of claim 6, comprising a third plurality of arms, which are rotatable and borne by the main body, which are arranged superiorly of the main body and which project from the main body so as to inferiorly abut the rocky material to be removed.

* * * * *